US005739489A

United States Patent [19]

Marmonier et al.

[11] Patent Number: 5,739,489

[45] Date of Patent: Apr. 14, 1998

[54] ROTARY MECHANISM FOR DRIVING SIGNALLING CONTACTS OF AN ELECTRICAL APPARATUS, IN PARTICULAR A HIGH VOLTAGE GROUNDING SWITCH OR DISCONNECTOR

[75] Inventors: Jean Marmonier, Aix Les Bains; Bernard Gelloz, St Offenge Dessous, both of France

[73] Assignee: GEC Alsthom T & D SA, Paris, France

[21] Appl. No.: 729,157

[22] Filed: Oct. 11, 1996

[30] Foreign Application Priority Data

Oct. 13, 1995 [FR] France ..... 95 12025

[51] Int. Cl.[6] ..... H01H 3/00; H01H 9/26

[52] U.S. Cl. ..... 200/17 R; 200/18; 200/50.32

[58] Field of Search ..... 200/118, 17 R, 200/18, 36–38 R, 48 R, 48 A, 50.32–50.34, 336, 410, 416, 426, 448, 564–568, 570, 573, 574; 74/436

[56] References Cited

U.S. PATENT DOCUMENTS

| | | | |
|---|---|---|---|
| 4,339,636 | 7/1982 | Cleaveland et al. | 200/48 A |
| 5,169,121 | 12/1992 | Blanco et al. | 251/129.12 |
| 5,516,993 | 5/1996 | Wecke et al. | 200/17 R |
| 5,587,569 | 12/1996 | Mohtasham | 200/17 R |

FOREIGN PATENT DOCUMENTS

| | | |
|---|---|---|
| 2092316 | 1/1972 | France . |
| 2617331 | 12/1988 | France . |
| 754869 | 4/1954 | Germany . |

*Primary Examiner*—Cassandra C. Spyrou
*Assistant Examiner*—Michael J. Hayes
*Attorney, Agent, or Firm*—Sughrue, Mion, Zinn, Macpeak & Seas, PLLC

[57] ABSTRACT

A drive mechanism for driving a rotary signalling switch of a high voltage electrical apparatus, in particular a disconnector or a grounding switch, the mechanism connecting the rotary shaft of the signalling switch to a rotary actuator shaft of an actuator mechanism for actuating the contacts of the apparatus so that the contacts of the signalling switch are opened or closed when the contacts of the apparatus are opened or closed, the actuator shaft being displaced at an angular velocity $\omega_{hr}$ during an operation to open or close the contacts of the apparatus. The drive mechanism constitutes a positive action mechanism connected between said drive shaft and said rotary shaft, and includes drive device for driving the rotary shaft of the signalling switch at the beginning and at the end of an operation at a velocity $\omega_{cs}$ greater than $\omega_{hr}$.

5 Claims, 2 Drawing Sheets

ROTARY MECHANISM FOR DRIVING SIGNALLING CONTACTS OF AN ELECTRICAL APPARATUS, IN PARTICULAR A HIGH VOLTAGE GROUNDING SWITCH OR DISCONNECTOR

FIELD OF THE INVENTION

The present invention relates to a mechanism for driving signalling contacts of an electrical apparatus, in particular a grounding switch or a high voltage disconnector.

More precisely, the invention relates to a mechanism for driving a rotary signalling switch of a high voltage electrical apparatus, in particular a disconnector or a grounding switch, the mechanism connecting the rotary shaft of the signalling switch to a rotary actuator shaft of an actuator mechanism for actuating the contacts of the apparatus so that the contacts of the signalling switch are opened or closed when the contacts of the apparatus are opened or closed, the actuator shaft being displaced at an angular velocity $\omega_{ht}$ during an operation to open or close the contacts of the apparatus.

BACKGROUND OF THE INVENTION

The mechanisms presently in use for driving the signalling switches of a high voltage disconnector or of a grounding switch are generally of the snap-action type. They comprise a cam secured to the actuator shaft of the mechanism for actuating the contacts of the apparatus and itself actuating a spring or lever switch. This serves to obtain fast switch-operation at the end of the stroke.

Nevertheless, those snap-action mechanisms suffer from problems of reliability. After breakage of the spring or the equivalent, there is a risk of position indication being incorrect. Also, manual action in the control box can give rise to inappropriate handling of the switch with consequent mismatch between the real position of the apparatus and the position-signalling contacts.

In high voltage circuit breakers, it is also known to make use of rotary signalling switches in which the rotary shaft is directly connected by a positive action drive mechanism, e.g. of the link type, to a shaft of the mechanism for actuating the contacts of the circuit breaker, which mechanism is itself a snap-action device. Since the mechanism for actuating the contacts of the circuit breaker is a snap-action device, the operating speed of the signalling switch is large.

Such rotary switches are generally made up of two facing fixed contacts each having a branch occupying a circular arc. The moving contact is constituted by two rotary bars with the fixed contacts engaging between the ends thereof in the closed position of the switch, thereby providing an electrical connection between the fixed contacts. Such a switch is described in greater detail in the description below.

It is not possible to transpose such mechanisms that are known for circuit breakers directly to high voltage disconnectors or earthing switches since account must be taken of the possibility of the apparatus being actuated slowly. In the event of a breakdown of the actuator motor or the equivalent, the operation is performed manually using a handle, i.e. at a speed that is not controlled and that can be small. The operating speed of position signalling switches would then be too small and incompatible with the required turnoff performance. That can result in erosion by electric arc. Another problem consists in the difficulty of obtaining good accuracy concerning the instant at which the signalling switch contacts close and open relative to the main apparatus.

OBJECTS AND SUMMARY OF THE INVENTION

The present invention solves these problems by providing a drive mechanism which, while still being a positive action mechanism, is adapted to high voltage disconnectors and to grounding switches.

To do this, according to the invention, the drive mechanism constitutes a positive action mechanism connected between said actuator shaft and said rotary shaft, and includes drive means for driving the rotary shaft of the signalling switch at the beginning and at the end of an operation at a velocity $\omega_{cs}$ greater than $\omega_{ht}$.

The term "positive action" is used to mean that there exists both-way linkage between the two shafts and thus between the high voltage apparatus and the position signalling switch, and that each position of the contacts of the main apparatus corresponds to a single position of the position-signalling contact.

In a preferred embodiment, said drive means comprise two studs secured to said actuator shaft, situated in a plane perpendicular to said shaft and equidistant from said shaft, and a disk having its center secured to said rotary shaft, occupying a plane perpendicular to said shaft, and provided with two radially-extending slots, each designed to receive one of said studs, the two shafts being parallel.

Advantageously, the slots are symmetrical about a plane passing through the center of the disk.

Preferably, starting from the periphery of the disk, each slot includes at least a first sector in the form of a circular arc of radius equal to the distance between each stud and the shaft, and the shaft extends along an axis passing through the center of the corresponding circle.

In the vicinity of the rotary shaft, each of said slots is extended by an end second sector for stabilization purposes.

BRIEF DESCRIPTION OF THE DRAWINGS

The invention is described below in greater detail with reference to the figures which show only a preferred embodiment of the invention.

MORE DETAILED DESCRIPTION

Figure 1:
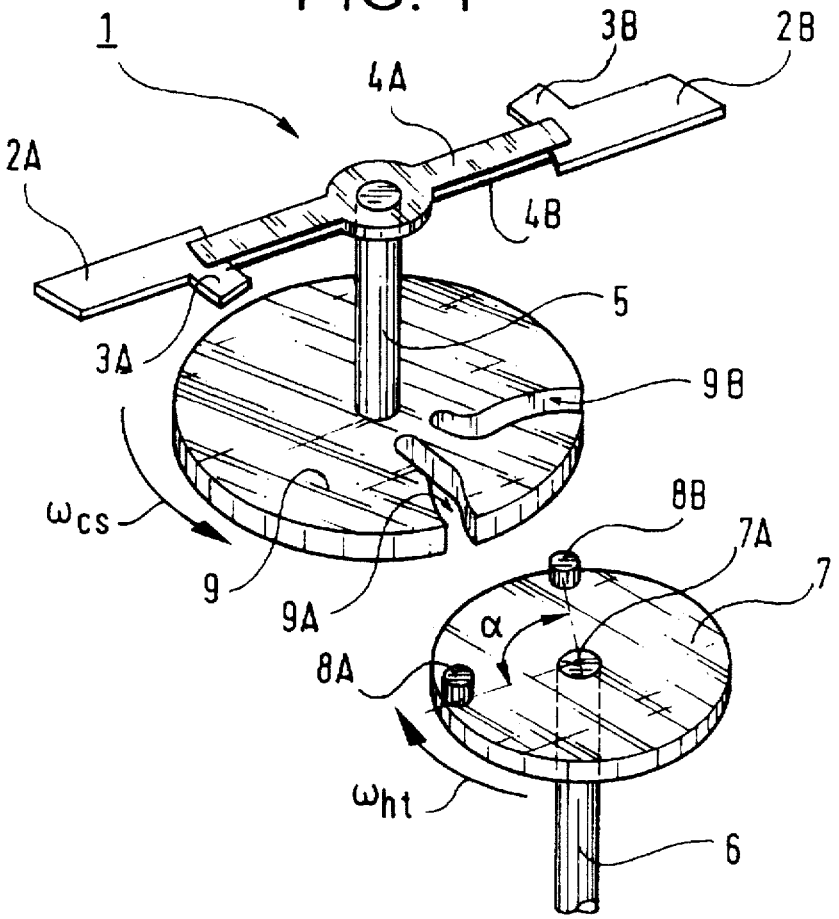
FIG. 1 is an exploded perspective view of the drive mechanism of the invention.

A rotary switch 1 is shown in FIG. 1. It comprises two facing fixed contacts 2A and 2B each having a branch 3A, 3B in the form of an arc of a circle. The moving contact is constituted by two bars 4A, 4B urged towards each other with a gap being left between them, and constrained to rotate with a shaft 5 referred to as the switch rotary shaft. When the switch is in its closed position, the ends of the branches 4A and 4B of the moving contact come into contact with the fixed contacts 2A and 2B by the fixed contacts being engaged between said ends, thereby providing an electrical connection between the fixed contacts 2A and 2B. When the moving contact rotates, the moving branches 4A and 4B move away from the fixed contacts 2A and 2B, and the switch is opened.

Such a rotary switch 1 is known per se.

It serves as a signalling switch for a high voltage electrical apparatus, in particular a disconnector or an earthing switch, and it does so by having its rotary shaft 5 connected to a rotary actuator shaft 6 of an actuator mechanism for actuating the contacts of the main apparatus. This connection is such that the contacts of the switch 1 are opened or closed when the contacts of the apparatus are opened or closed.

To do this, the connection between the two shafts 5 and 6 is provided by the drive mechanism of the invention which is described below.

A first disk 7 is secured to the actuator shaft 6 so as to occupy a plane perpendicular to said shaft, and it carries two studs 8A and 8B that are both at the same distance from the center 7A of the first disk 7 and that are angularly spaced apart by an angle at the center $\alpha$.

A second disk 9 is secured to the shaft 5 for rotating the switch 1, so as to occupy a plane perpendicular to said shaft, and it is provided with two radial grooves or slots 9A and 9B, of a shape that is described in greater detail below with reference to FIG. 2.

The two shafts 5 and 6 are parallel and the two disks 7 and 9 are located relative to each other in such a manner that when the actuator shaft 6 rotates at an angular velocity $\omega_{hr}$ during an operation to open or close the electrical apparatus, the studs 8A, 8B engage in the slots 9A, 9B and, at the beginning and at the end of the operation they rotate the second disk 9 at an angular velocity $\omega_{cs}$ greater than $\omega_{hr}$.

Figure 2:
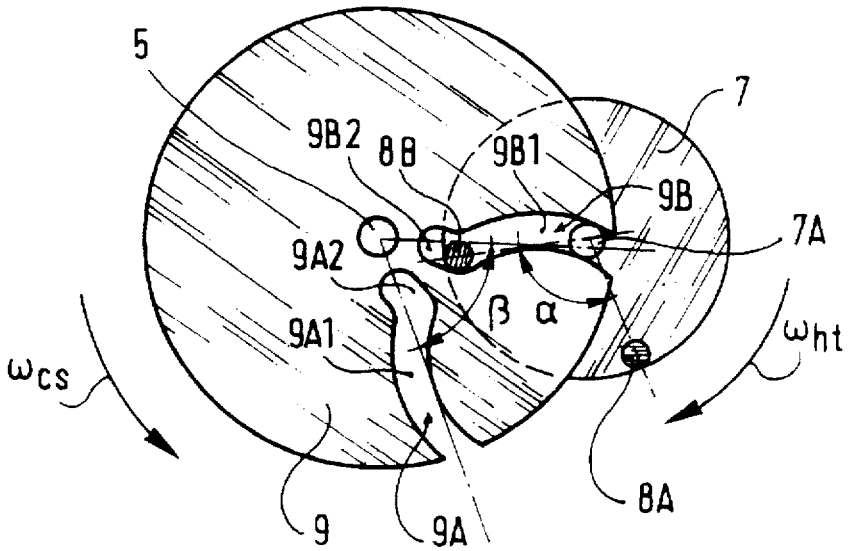
FIG. 2 is a plan view of the mechanism.

A preferred embodiment of this preferred disposition is visible in FIG. 2.

The slots 9A, 9B are symmetrical about a plane passing through the center of the second disk 9 where the rotary shaft 5 of the switch 1 is secured and bisecting the angle $\beta$. They extend radially and open out to the periphery of the disk 9 at points that are angularly spaced apart by an angle at the center $\beta$.

Figures 3A, 3B, 3C, 3D:
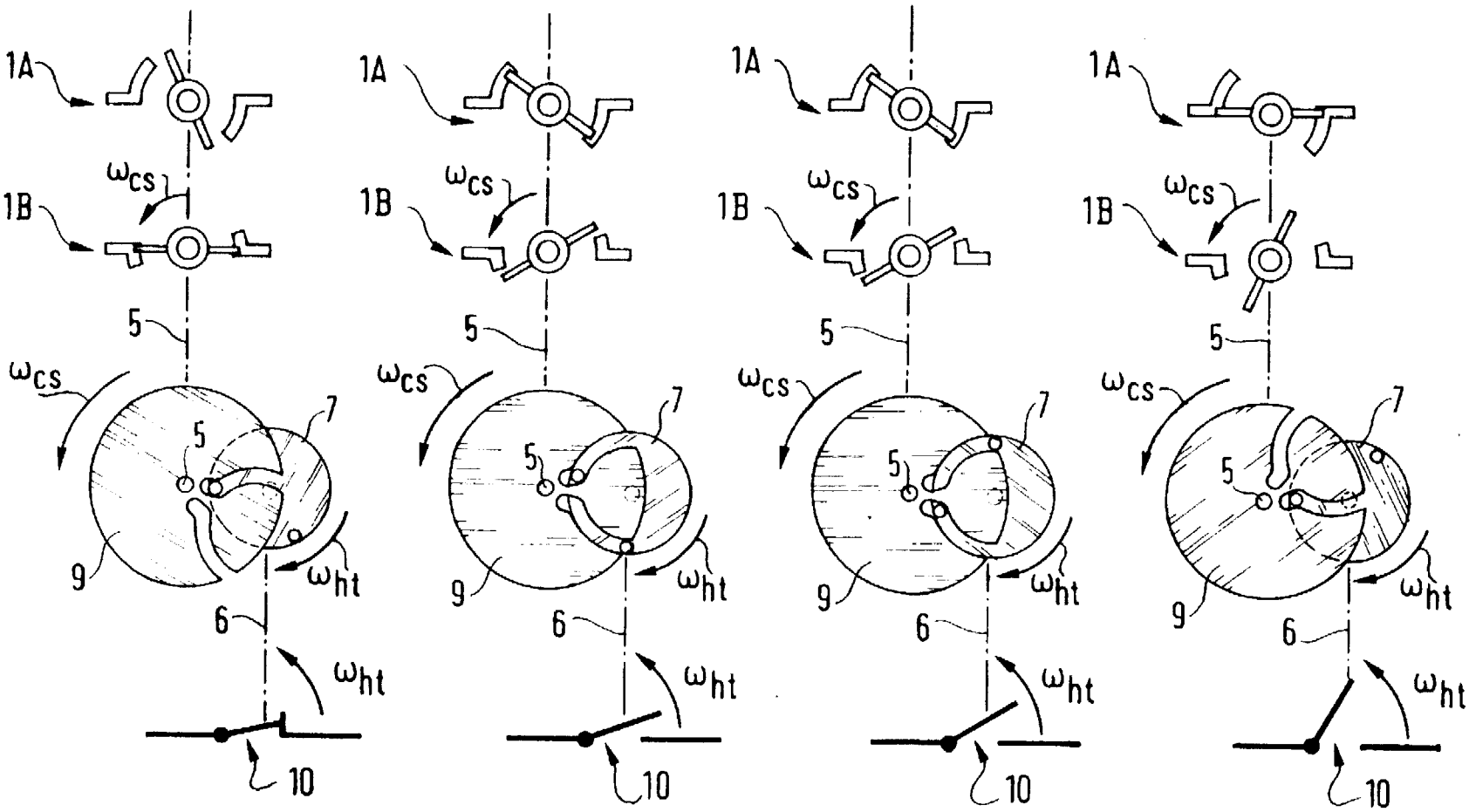
FIGS. 3A to 3D are views showing, diagrammatically, the operation of the drive mechanism of the invention during an operation of opening the electrical apparatus.

Going from the periphery of the disk 9, each of them has a first sector 9A1, 9B1 in the form of a circular arc of radius equal to the distance between each of the studs 8A, 8B and the center 7A of the first disk 7. The actuator shaft 6 is disposed along the axis passing through the center of the corresponding circle when the disk 9 is in its middle position as shown in FIGS. 3B and 3C.

Close to the shaft 5, i.e. close to the center of the second disk 9, each of the slots is extended for stabilization purposes near the shaft 5 by an end second sector 9A2, 9B2 that is preferably substantially rectilinear and parallel to the plane of symmetry of the two slots 9A, 9B.

The two disks 7 and 9 are disposed relative to each other in such a manner that during rotation of the first disk 7, the stud 8A is engaged in the slot 9A or the stud 8B is engaged in the slot 9B, thereby ensuring positive linkage between the two disks 7 and 9 and thus between the actuator shaft 6 of the mechanism for actuating the main apparatus and the rotary shaft 5 for rotating the switch 1. In addition, the size of the second disk 9 and of its slots 9A, 9B, the distance between each of the studs 8A, 8B and the center 7A of the first disk 7, and the size of the angle $\alpha$ are all selected so as to obtain a full stroke of the moving contact of the switch 1 in correspondence with the full rotary stroke of the actuator shaft 6 of the mechanism for actuating the contacts of the main apparatus. The dimensions are also selected so that at least one of the two studs is engaged with one of the sectors 9A and 9B at all times.

The operation of the drive mechanism is shown in FIGS. 3A to 3D.

These figures show a first signalling switch 1A and a second signalling switch 1B sharing a common rotary shaft symbolized by line 5 and connected to the actuator shaft symbolized by line 6 of the mechanism for actuating the contacts of a disconnector shown symbolically at 10.

The first signalling switch 1A is designed to be open when the disconnector 10 is closed and to be closed when the disconnector 10 is open. Conversely, the second switch 1B is designed to be closed when the disconnector 10 is closed and to be open when the disconnector 10 is open. More than two switches may be associated with the disconnector 10 on the same principles.

When the disconnector 10 is in its closed position (FIG. 3A), stud 8B of the first disk 7 is in the end sector of slot 9B of the second disk 9.

While the disconnector 10 is being opened, the actuator shaft 6, and thus the first disk 7, rotates at an angular velocity $\omega_{hr}$ that is assumed to be constant.

At the beginning of opening, the stud 8B drives the second disk 9 and thus the shaft 5 for rotating the switches 1A, 1B at an angular velocity $\omega_{cs}$ greater than the velocity $\omega_{hr}$, the end section of the slot 9B being close to the shaft 5. The signalling switches therefore move quickly to the closed position for the first switch 1A and the open position for the second switch 1B.

This drive continues until the position shown in FIG. 3B is reached, where the first sectors 9A1, 9B1 that are circularly arcuate in shape coincide with the path followed by the studs 8A, 8B. The stud 8B disengages from the slot 9A and the stud 8A takes up a position in the end sector of the slot 9A (FIG. 3C) without any associated movement of the second disk 9. The position-signalling switches 1A and 1B remain stationary.

In the end portion of the slot 9A the stud 8A then drives the disk 9 and thus the shaft 5 at an angular velocity $\omega_{cs}$ greater than the velocity $\omega_{hr}$. The switches rapidly finish off their displacement to close the first switch 1A and to open the second switch 1B.

Whatever the velocity $\omega_{hr}$ with which the main contacts of the disconnector 10 are actuated, and even when said velocity is very slow and varying as can happen in the event of the disconnector being actuated manually, the angular velocity $\omega_{cs}$ of the switch is fast, thereby ensuring that opening and closing takes place cleanly and reliably, while nevertheless guaranteeing positive mechanical linkage throughout the entire operation.

The above-described mechanism acts as a step-up mechanism at the beginning and at the end of an operation and as an infinite step-down mechanism ($\omega_{cs}=0$) during the intermediate portion of an operation. This step-up and step-down effect can be obtained for slots 9A, 9B that are different in shape from those described above which corresponds merely to a preferred embodiment. One example would be to make radial slots that are rectilinear. The step-up effect would then be the same while the step-down effect would be large but not infinite.

We claim:

1. A drive mechanism in a high voltage electrical apparatus comprising one of a disconnector and a grounding switch, wherein said one of a disconnector and a grounding switch includes main contacts, the high voltage electrical apparatus including main contacts, a rotary signalling switch having a rotary switch shaft and switch contacts, and an actuator mechanism having a rotary actuator shaft and for actuating the main contacts, the drive mechanism connecting the rotary switch shaft of the rotary signalling switch to the rotary actuator shaft of the actuator mechanism, the actuator shaft being displaced at an angular velocity $\omega_{hr}$ during an operation to open or close the main contacts of the high voltage electrical apparatus, the drive mechanism comprising a positive action mechanism connected between said rotary actuator shaft and said rotary switch shaft, and including means for driving the rotary switch shaft of the rotary signalling switch at the beginning and at the end of an operation at a velocity $\omega_{cs}$ greater than $\omega_{hr}$, so that the switch contacts of the rotary signalling switch are opened or closed when the main contacts of the high voltage electrical apparatus are opened or closed.

2. A mechanism according to claim 1, wherein said drive means comprises two studs secured to said rotary actuator shaft, situated in a plane perpendicular to said rotary actuator shaft and equidistant from said rotary actuator shaft, and a disk having its center secured to said rotary switch shaft, occupying a plane perpendicular to said rotary switch shaft, and provided with two radially-extending slots, each designed to receive one of said studs, the rotary actuator shaft and the rotary switch shaft being parallel.

3. A mechanism according to claim 2, wherein the slots are symmetrical about a plane passing through the center of the disk.

4. A mechanism according to claim 3, wherein, starting from the periphery of the disk, each slot includes at least a first sector in the form of a circular arc of radius equal to the distance between each stud and the rotary actuator shaft, and wherein the rotary actuator shaft is aligned with said plane, which passes through the center of the disk, when the disk is in a middle position of rotation.

5. A mechanism according to claim 4, wherein, in the vicinity of the rotary switch shaft, each of said slots is extended by an end second sector for stabilization purposes.

* * * * *